US009169817B2

(12) United States Patent
Zeng et al.

(10) Patent No.: US 9,169,817 B2
(45) Date of Patent: Oct. 27, 2015

(54) FUEL PUMP WITH METERING VALVE

(71) Applicant: Ford Global Technologies, LLC, Dearborn, MI (US)

(72) Inventors: Paul Zeng, Inkster, MI (US); Vince Paul Solferino, Dearborn, MI (US); Patrick Brostrom, Clarkston, MI (US); Kyi Shiah, Northville, MI (US); Joseph F. Basmaji, Waterford, MI (US); Scott Lehto, Walled Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 240 days.

(21) Appl. No.: 13/706,131

(22) Filed: Dec. 5, 2012

(65) Prior Publication Data

US 2014/0154100 A1 Jun. 5, 2014

(51) Int. Cl.

| | |
|---|---|
| ***F04B 49/22*** | (2006.01) |
| ***F02M 69/02*** | (2006.01) |
| ***F04B 49/24*** | (2006.01) |
| ***F02M 59/36*** | (2006.01) |
| ***F02M 63/00*** | (2006.01) |
| *F02D 41/38* | (2006.01) |

(52) U.S. Cl.

CPC ..... *F02M 69/02* (2013.01); *F02M 59/367* (2013.01); *F02M 63/0015* (2013.01); *F04B 49/243* (2013.01); *F02D 41/3845* (2013.01)

(58) Field of Classification Search

CPC . F02M 69/02; F02M 59/367; F02M 63/0015; F04B 49/243; F04B 49/02; F04B 49/03; F04B 49/22; F04B 49/24; F02D 41/3845

USPC ..... 417/298, 437

See application file for complete search history.

(56) References Cited

U.S. PATENT DOCUMENTS

| | | | | |
|---|---|---|---|---|
| 4,613,026 | A | 9/1986 | Ohzono et al. | |
| 4,730,987 | A * | 3/1988 | Kawai et al. | 417/270 |
| 5,364,066 | A | 11/1994 | Dorste et al. | |

(Continued)

FOREIGN PATENT DOCUMENTS

| | | | |
|---|---|---|---|
| JP | S63167024 | A | 7/1988 |
| JP | H04308374 | A | 10/1992 |

(Continued)

OTHER PUBLICATIONS

Zeng, Paul et al., "Fuel Pump with Quiet Cam Operated Suction Valve," U.S. Appl. No. 13/399,713, filed Feb. 17, 2012, 47 pages.

(Continued)

*Primary Examiner* — Charles Freay
*Assistant Examiner* — Philip Stimpert
(74) *Attorney, Agent, or Firm* — James Dottavio; Alleman Hall McCoy Russell & Tuttle LLP

(57) ABSTRACT

A method for operating a fuel pump is provided. The method may include decreasing a pump chamber pressure, passively opening a metering valve coupled to a pump chamber in response to the decreasing, and while the metering valve is open, generating a rotational output via a motor, transferring the rotational output into an actuation force applied to the metering valve via a metering valve actuation device, and inhibiting the metering valve from closing via sustaining application of the actuation force.

20 Claims, 7 Drawing Sheets

(56) References Cited

U.S. PATENT DOCUMENTS

| | | | | |
|---|---|---|---|---|
| 6,053,712 | A | 4/2000 | Konishi et al. | |
| 6,095,774 | A | 8/2000 | Tanaka et al. | |
| 6,375,086 | B1 | 4/2002 | Babin et al. | |
| 6,694,952 | B1 | 2/2004 | Yamazaki et al. | |
| 6,889,662 | B2 * | 5/2005 | Hess | 123/467 |
| 7,373,924 | B1 | 5/2008 | Krengel et al. | |
| 7,721,716 | B1 | 5/2010 | Harwood | |
| 7,827,967 | B2 | 11/2010 | Beardmore | |
| 2003/0051757 | A1 | 3/2003 | Roth et al. | |
| 2008/0047531 | A1 | 2/2008 | Breuer et al. | |
| 2009/0126688 | A1 | 5/2009 | Borg et al. | |
| 2012/0138021 | A1 | 6/2012 | Kim et al. | |

FOREIGN PATENT DOCUMENTS

| | | | |
|---|---|---|---|
| JP | 2001090633 | A | 4/2001 |
| JP | 2010168901 | A | 8/2010 |

OTHER PUBLICATIONS

Zeng, Paul et al., "Fuel Pump with Quiet Rotating Suction Valve," U.S. Appl. No. 13/399,842, filed Feb. 17, 2012, 48 pages.

Zeng, Paul et al., "Fuel Pump with Quiet Volume Control Operated Suction Valve," U.S. Appl. No. 13/399,897, filed Feb. 17, 2012, 47 pages.

* cited by examiner

FUEL PUMP WITH METERING VALVE

FIELD

The present description relates to a fuel pump for supplying fuel to an internal combustion engine. The fuel pump may cooperate with engines that include fuel injectors that inject fuel directly into engine cylinders.

BACKGROUND AND SUMMARY

Diesel and direct injection gasoline engines may have fuel injection systems that directly inject fuel into engine cylinders. The fuel is injected to an engine cylinder at a higher pressure so that fuel can enter the cylinder during the compression stroke against elevated cylinder pressure. The fuel may be elevated to the higher pressure by a mechanically driven fuel pump. Fuel pressure at the outlet of the fuel pump is controlled by adjusting an amount of fuel that flows through the fuel pump.

One way to control flow through the fuel pump is via a solenoid operated metering valve. In one example, the solenoid is operated to close the metering valve during a pumping phase of the fuel pump. Closing the metering valve prevents fuel from flowing into or out of an inlet of the fuel pump. The closing time of the metering valve may be adjusted to control flow through the fuel pump. However, when the solenoid changes state to allow the metering valve to open or close, the solenoid or a portion of metering valve impacts a surface within the metering valve housing. The impact can produce noise, vibration, and harshness (NVH) in the pump as well as the surrounding components. Specifically, the impact may generate a ticking noise. As a result, customer dissatisfaction may be increased. The vibration from the impact may also damage components in the fuel pump, as well as the surrounding components (e.g., engine block, oil pan, cam covers, front cover, and/or intake and exhaust manifolds) through vibrational propagation, thereby decreasing component longevity.

The inventors herein have recognized the above-mentioned disadvantages and have developed a method for operating a fuel pump. The method may include decreasing a pump chamber pressure, passively opening a metering valve coupled to a pump chamber in response to the decreasing, and while the metering valve is open, generating a rotational output via a motor, transferring the rotational output into an actuation force applied to the metering valve via a metering valve actuation device, and inhibiting the metering valve from closing via sustaining application of the actuation force.

In this way, the metering valve may be passively opened without any NVH and during certain operating conditions the metering valve actuation device is configured to inhibit the metering valve from closing, enabling the amount of the fuel supplied by the fuel pump to downstream components (e.g., the fuel rail) to be adjusted. As a result, fuel pressure control is improved.

The type of metering valve actuation device used in the pump may be selected to reduce (e.g., substantially inhibit) NVH caused by contact between the metering valve and the metering valve actuation device. In one example, the metering valve actuation device is a screw slider configured to translate a rotational force from the motor into a linear actuating force applied to the metering valve. It will be appreciated that the screw slider velocity may approach zero when contacting the metering valve. Thus, the fuel pump can be operated with little or no impact between the metering valve and the metering valve actuation device. As a result, metering valve opening and closing noises may be reduced when compared to solenoid operated metering valves.

In another example, the metering valve may be a reed valve. When a reed valve is used in the fuel pump the likelihood of vibration caused by read valve impact is reduced. Furthermore, the reed valve may be less costly than other types of valves such as check valves or solenoid valves, thereby reducing the cost of the fuel pump.

The present description provides several advantages such as reducing fuel delivery system noise, increasing the longevity of the fuel pump and surrounding components, and providing improved fuel pressure control.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an example, referred to herein as the Detailed Description, when taken alone or with reference to the drawings, where.

DETAILED DESCRIPTION

The present description is related to a fuel pump in a fuel delivery system of an engine. The fuel pump may include a metering valve that is passively opened based on a fuel pressure in a pump chamber and inhibited from closing via a metering valve actuation device when fuel pump output adjustment is requested. The metering valve actuation device is designed to reduce the impact between the metering valve and a pump chamber inlet as well as the metering valve actuation device. For instance, the metering valve actuation device may be a screw slider configured to transfer a rotational output from a motor into a linear actuation force exerted on the metering valve. Transferring forces in this way decreases the speed of the linear actuation force, enabling the impact between the metering valve and the pump chamber inlet to be substantially reduced. As a result, noise, vibration, and harshness (NVH) in the fuel pump are reduced. Further in some examples, the metering valve may be a reed valve. Use of a reed valve in the fuel pump reduces the cost of the fuel pump when compared to fuel pumps using solenoid valves.

Figure 1:
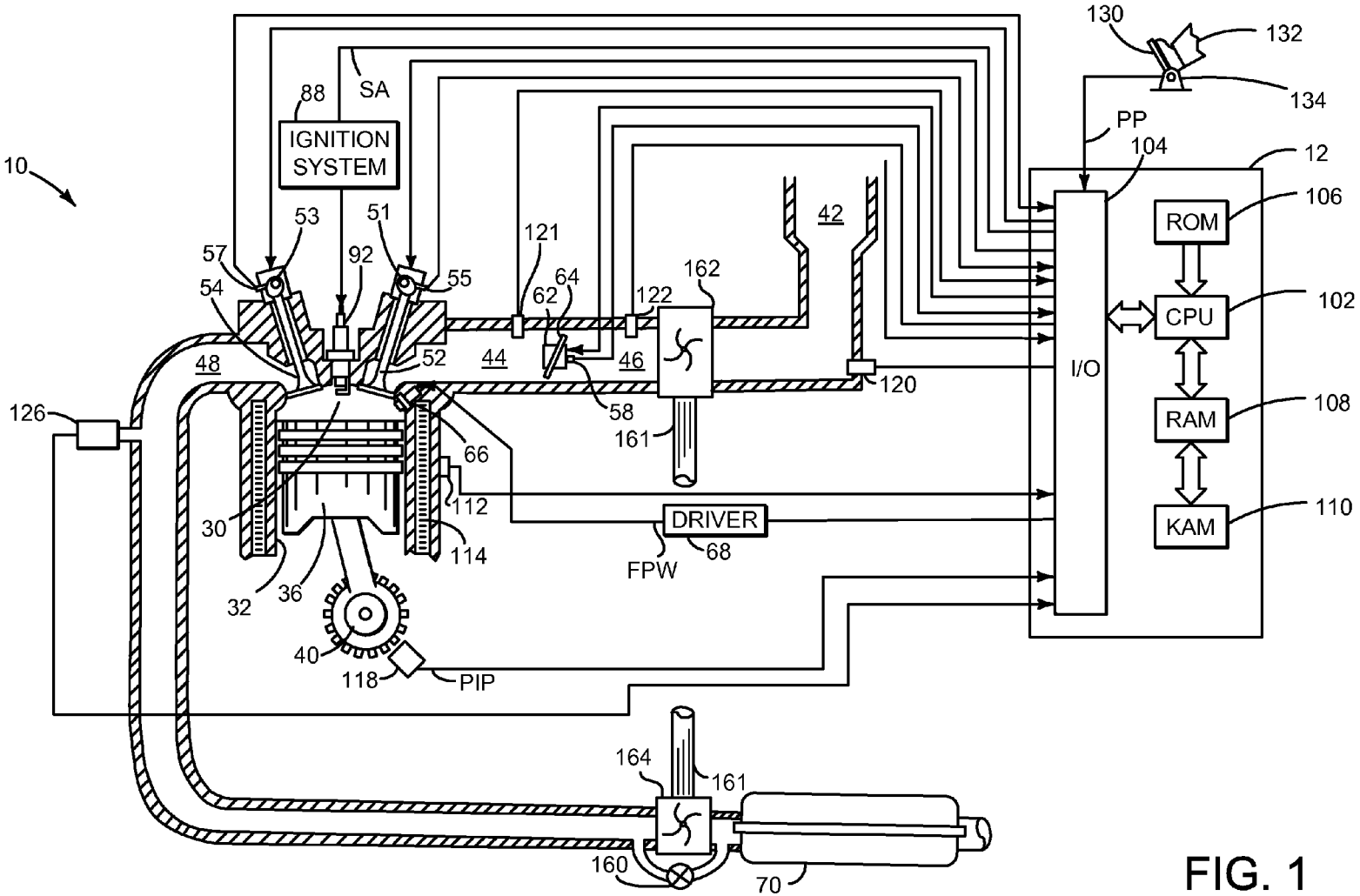
FIG. 1 is a schematic diagram of an example engine.
Figure 2:
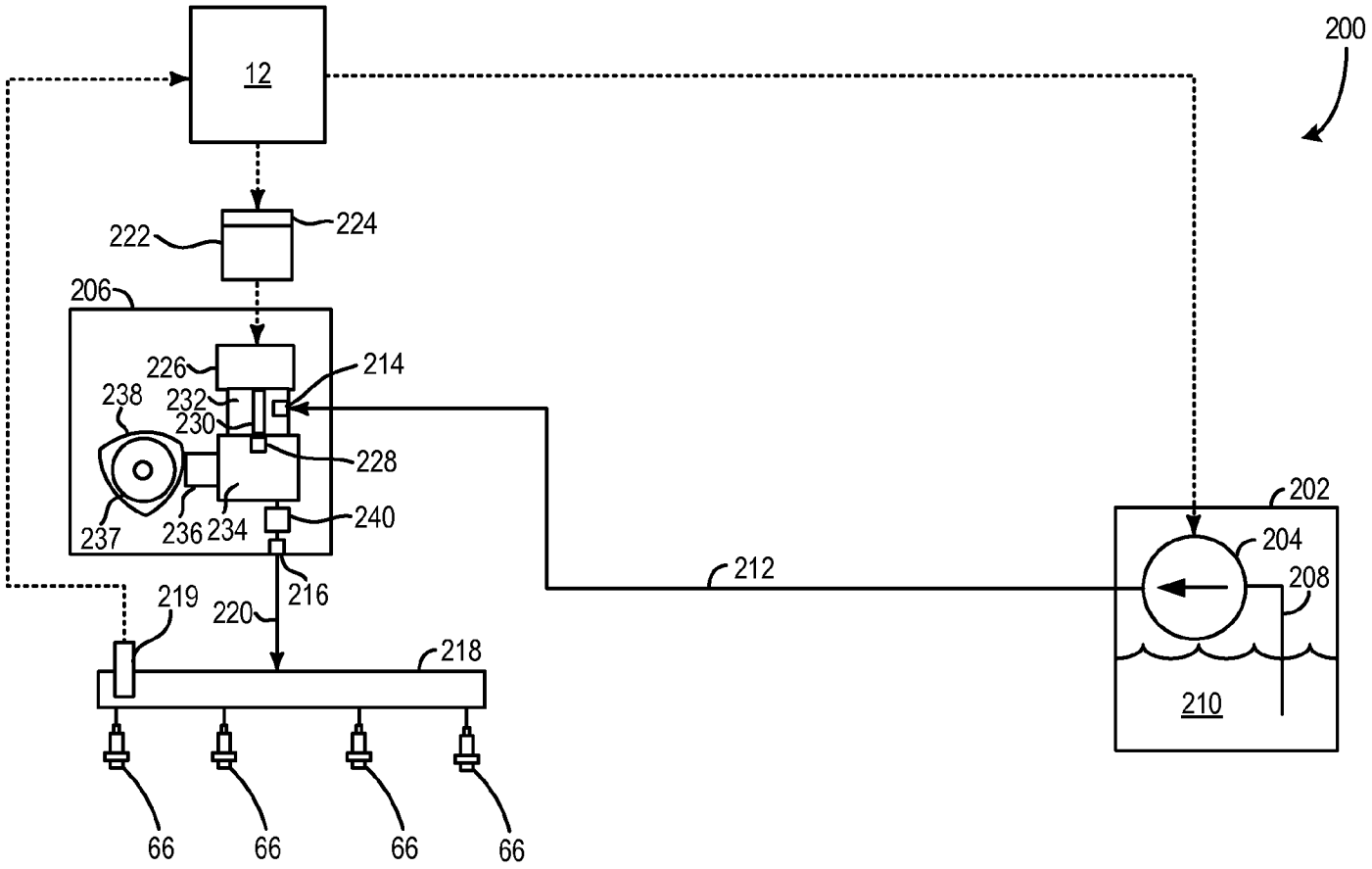
FIG. 2 is a schematic diagram of an example fuel delivery system for an engine.
Figure 3A:
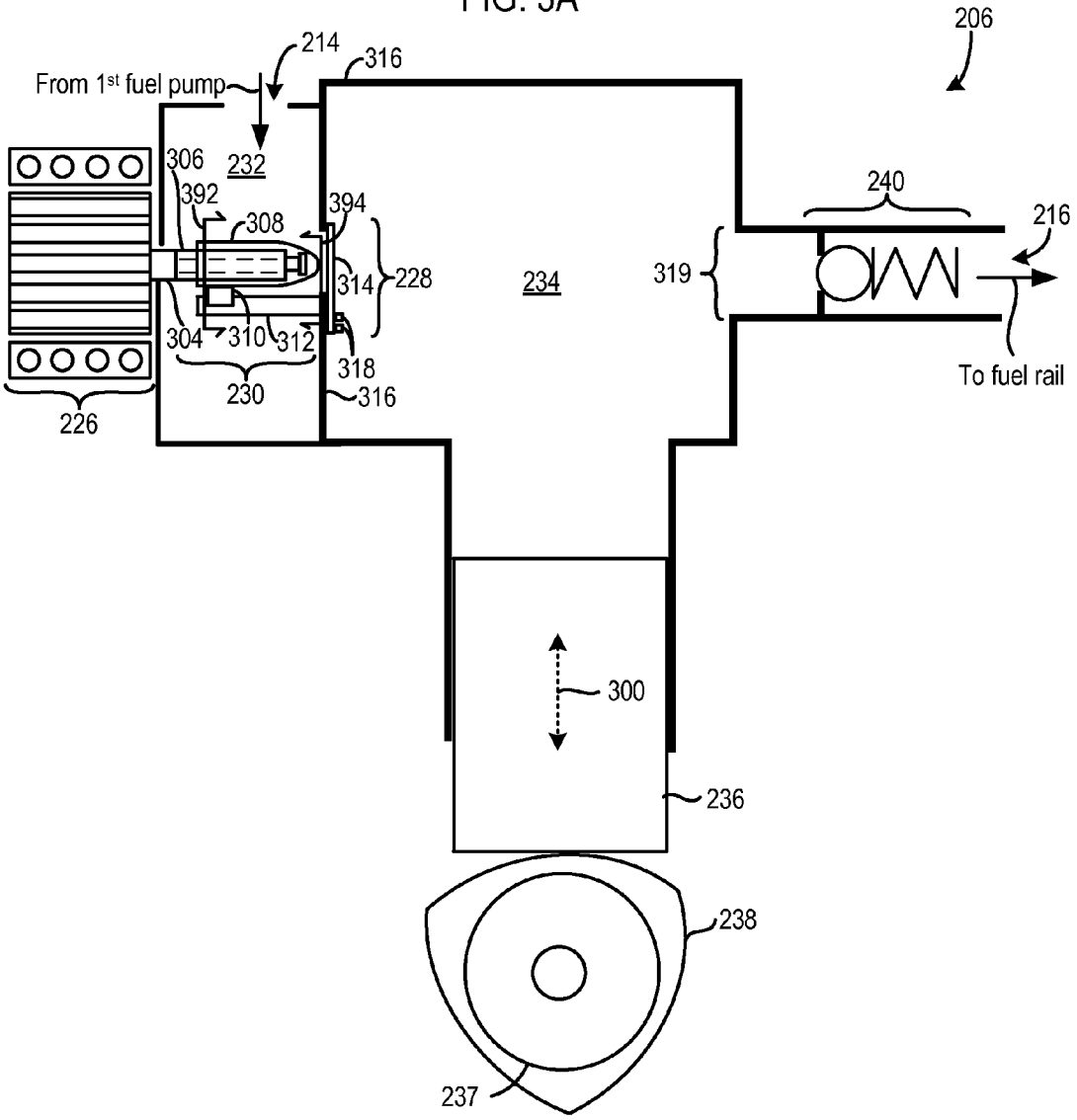
FIG. 3A shows an example second fuel pump included in the fuel delivery system shown in FIG. 2.
Figure 3B:
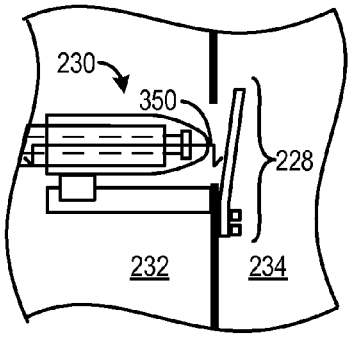
FIGS. 3B-3C show different configurations of the second fuel pump shown in FIG. 3A.
Figure 3C:
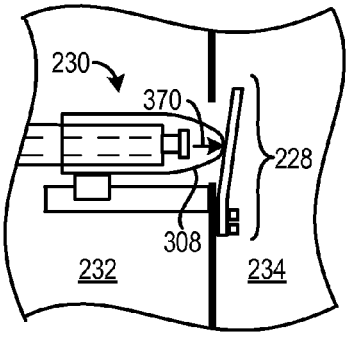
Figure 4:
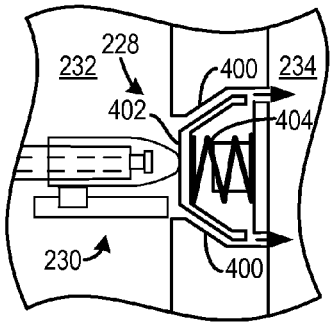
FIG. 4 shows another example metering valve which may be included in the second fuel pump included in the fuel delivery system shown in FIG. 2.
Figure 5A:
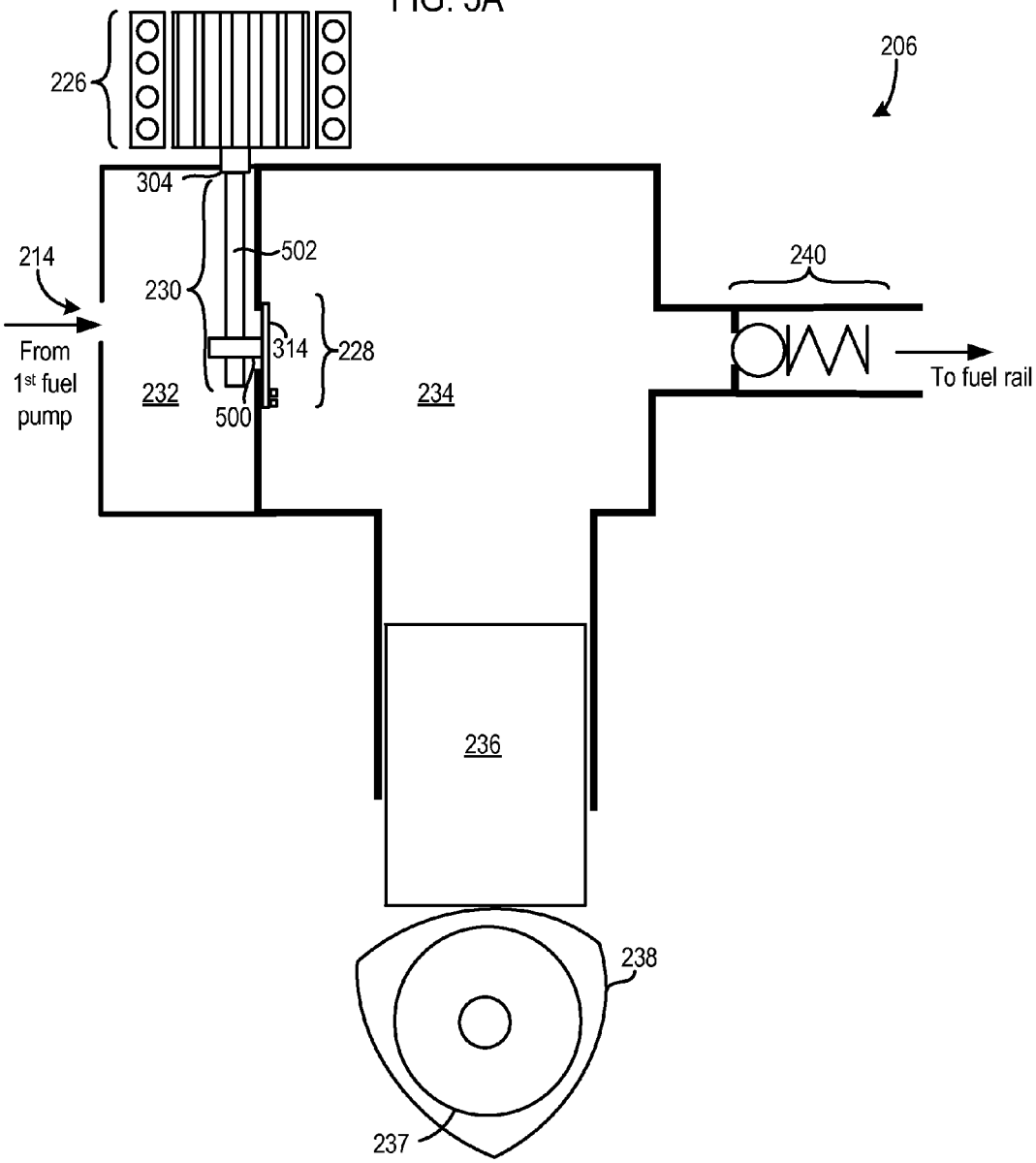
FIG. 5A shows another example of the second fuel pump included in the fuel delivery system shown in FIG. 2.
Figure 5B:
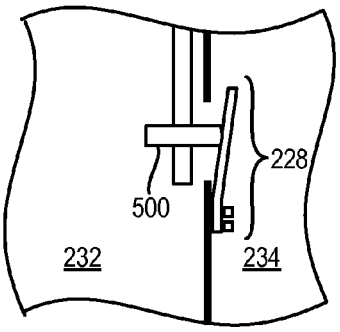
FIGS. 5B and 5C show different configurations of the second fuel pump shown in FIG. 5A.
Figure 5C:
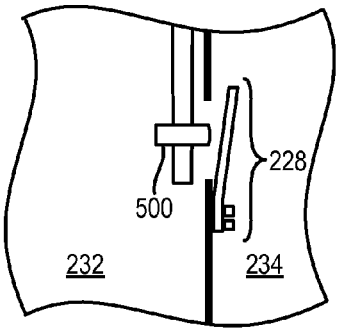
Figure 7:
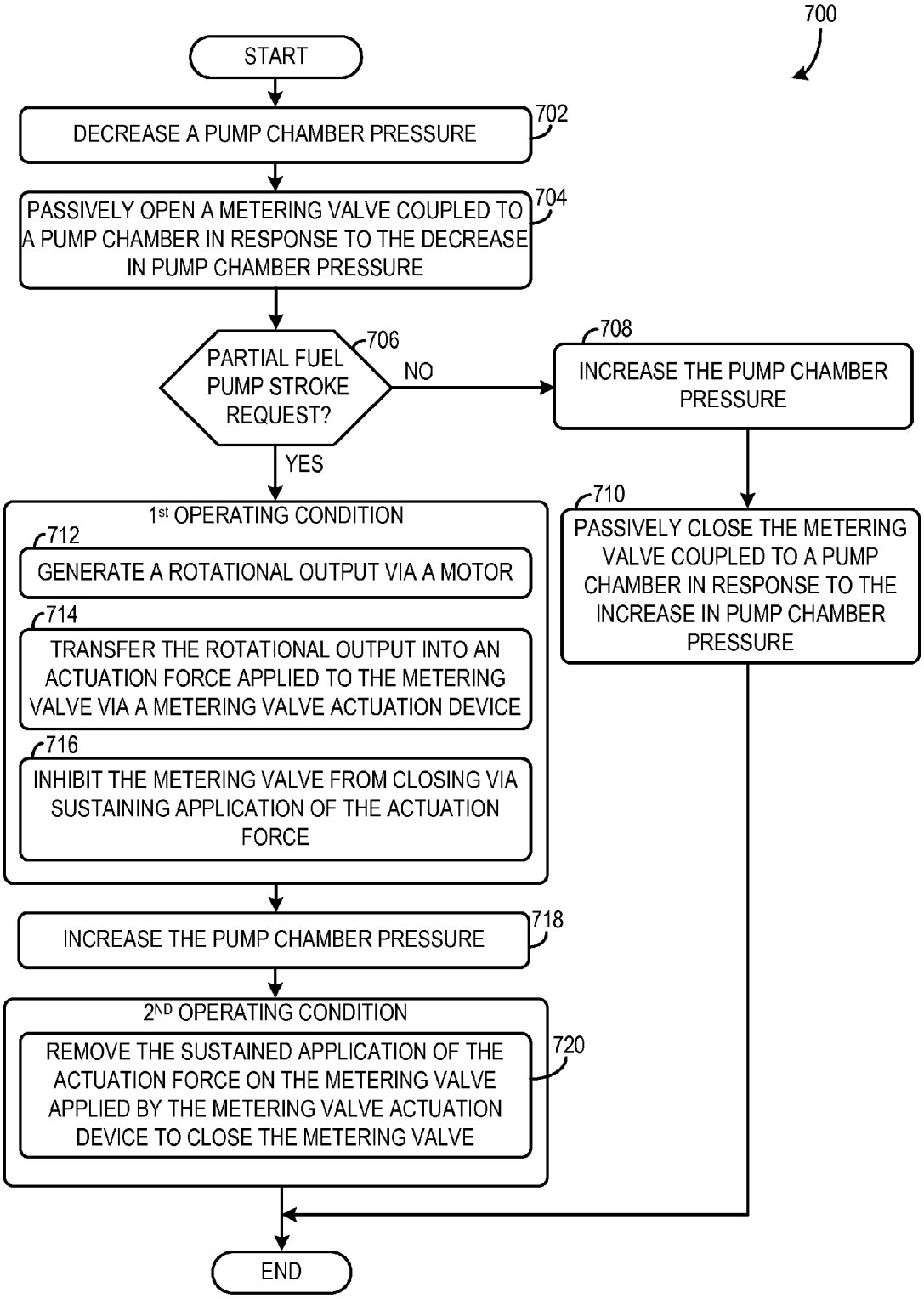
FIGS. 7 and 8 show methods for operation of a fuel pump.
Figure 8:
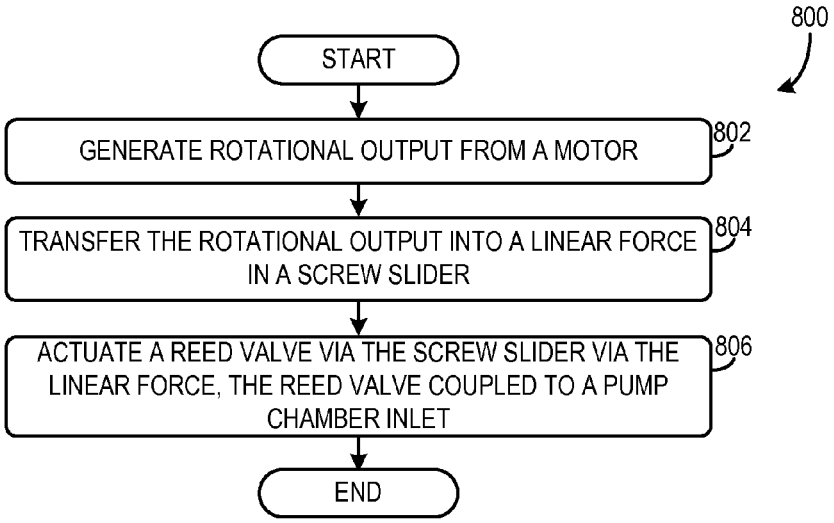

FIG. 1 shows an example direct injection gasoline engine. However, the fuel system described herein is equally applicable to diesel engines. FIG. 2 shows schematic of an example fuel delivery system in the engine shown in FIG. 1. FIG. 3A shows a first example of a second fuel pump included in the fuel delivery system shown in FIG. 2. FIG. 3B-3F show different view and/or configurations of the second fuel pump shown in FIG. 3A. FIG. 4 shows another example metering valve which may be included in the second fuel pump shown in FIG. 2. FIG. 5A shows a second example of the second fuel pump shown in FIG. 2. FIGS. 5B-5C show different configurations of the second fuel pump depicted in FIG. 5A. FIGS. 6A-6F show different types of cams that may be used in the second fuel pump shown in FIG. 5A. FIGS. 7 and 8 show methods for operating a fuel pump.

Referring to FIG. 1, internal combustion engine 10, comprising a plurality of cylinders, one cylinder of which is shown in FIG. 1, is controlled by electronic engine controller 12. The engine 10 may be included in a drive system of a vehicle 100 and provide motive power thereto. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Compressor 162 included in the engine 10 draws air from air intake 42 to supply boost chamber 46. Exhaust gases spin turbine 164 which is coupled to compressor 162 via shaft 161. Vacuum operated waste gate actuator 160 allows exhaust gases to bypass turbine 164 so that boost pressure can be controlled under varying operating conditions. The compressor 162, turbine 164, and shaft 161 are included in a turbocharger. However, in other examples, a boosting device, such as the turbocharger, may not be included in the engine 10. Still further in some examples, the turbine 164 may not be included in the engine 10 and the compressor 162 may be included in a supercharger, the compressor receiving rotational energy from the crankshaft 40.

Fuel injector 66 is shown positioned to inject fuel directly into combustion chamber 30, which is known to those skilled in the art as direct injection. Alternatively, fuel may be injected to an intake port, which is known to those skilled in the art as port injection. It will be appreciated that fuel injector 66 may be one of a plurality of fuel injectors. Fuel injector 66 delivers liquid fuel in proportion to the pulse width of signal FPW from controller 12. Fuel is delivered to fuel injector 66 by a fuel system (See FIG. 2) including a fuel tank, fuel pump, and fuel rail. Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 121 coupled to intake manifold 44; boost chamber pressure from pressure sensor 122; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 shows an example fuel delivery system 200 included in the engine 10, shown in FIG. 1. The fuel delivery system 200 includes a fuel tank 202. The fuel tank 202 is configured to store a suitable fuel such as gasoline, diesel, bio-diesel, alcohol (e.g., ethanol, methanol), etc.

A first fuel pump 204 may also be included in the fuel delivery system 200. The first fuel pump 204 is configured to flow fuel from the fuel tank 202 to a second fuel pump 206. The first fuel pump 204 may be a low pressure fuel pump and the second fuel pump 206 may be a high pressure fuel pump. The first fuel pump 204 includes a pick-up tube 208 positioned within the fuel tank 202. The pick-up tube 208 may be submerged in fuel 210 in the fuel tank 202. Furthermore, the first fuel pump 204 is shown enclosed within the fuel tank 202 in the example fuel delivery system 200 illustrated in FIG. 2. However, in other examples, the first fuel pump 204 may be positioned external to the fuel tank 202. Fuel line, denoted via arrow 212, provides fluidic communication between the first fuel pump 204 and the second fuel pump 206.

The second fuel pump 206 includes an inlet 214 and an outlet 216. The outlet 216 is in fluidic communication with a fuel rail 218. Fuel line, denoted via arrow 220, enables fluidic communication between the second fuel pump 206 and the fuel rail 218. A pressure sensor 219 is coupled to the fuel rail 218 and electronically coupled to controller 12. The pressure sensor 219 is configured to indicate the pressure of the fuel in the fuel rail 218.

The fuel rail 218 supplies fuel to one or more of the injectors 66. The fuel injector(s) 66 may be opened and closed according to commands issued by the controller 12. The fuel delivery system 200 may include controller 12. The controller 12 may supply metering valve opening and closing timing commands to the motor controller 222. In some examples, motor controller 222 may be integrated into controller 12. Controller 12 also receives engine camshaft and crankshaft position information as is shown in FIG. 1. Motor controller 222 receives motor position information from the encoder 224 which is mechanically coupled to the motor 226. The motor 226 may be a stepper motor (e.g., 3-phase stepper motor), DC motor, or DC brushless motor, for example. The motor 226 may be included in the second fuel pump 206. The motor controller 222 supplies current to windings of motor 226. Thus, the motor controller 222 may be energized by the motor controller 222. Motor 226 rotates to allow fuel to selectively flow though metering valve 228. In the depicted example, the motor 226 and the fuel pump metering valve 228 are included in the second fuel pump 206. The second fuel pump 206 further includes a metering valve actuation device 230, supply chamber 232, pump chamber 234, and plunger 236. The second fuel pump 206 also includes cam 238 coupled (e.g., fixedly coupled) to the camshaft 237. The camshaft may be an intake camshaft or an exhaust camshaft, in one example. The cam 238 may be an intake cam configured to actuate an intake valve or an exhaust cam configured to actuate an exhaust cam in another example. However, the cam 238 may not be configured to actuate an intake or an exhaust valve in some examples. The second fuel pump 206 also includes a check valve 240. Operation of the second fuel pump 206 is discussed in greater detail herein with regard to FIG. 3A.

FIG. 3A shows a first example of the second fuel pump 206. The inlet 214 and outlet 216 of the second fuel pump 206 are illustrated. As previously discussed, the inlet 214 is in fluidic communication with the fuel tank 202 and the first fuel pump 204, shown in FIG. 2. Thus, the first fuel pump 204 supplies fuel to the second fuel pump 206.

The plunger 236 is shown positioned in the pump chamber 234. The plunger 236 reciprocates in the directions indicated at 300 when the cam 238 applies force to the plunger 236. Specifically, a lobe of the cam may apply the force to the plunger.

The cam 238 rotates with camshaft 237 which rotates as the engine rotates. Camshaft 237 may rotate at one half of crankshaft speed. When camshaft 237 rotates to a position where a maximum lift (e.g., any one of the peaks of the lobes of the cam 238) of the cam 238 is in contact with the plunger 236, the plunger 236 is positioned in the pump chamber 234 such that the unoccupied volume in the pump chamber 234 is at a minimum value. When the camshaft 237 rotates to a position where a minimum lift (e.g., any one of the low sections of cam 238) of the cam 238 is in contact with the plunger 236, the plunger 236 is positioned in the pump chamber 234 (e.g., the region where fuel may be pressurized in the second fuel pump 206) such that the volume of the pump chamber 234 is at a maximum value. Thus, when fuel is present in the pump chamber 234 while a metering valve 228, discussed in greater detail herein, is closed, fuel pressure can be increased within the second fuel pump 206 by decreasing the volume of pump chamber 234 and vice-versa. Therefore, the pressure in the pump chamber 234 may altered by movement of the plunger 236.

The inlet 214 opens into a supply chamber 232. Thus, the supply chamber 232 receives fuel from upstream component in the fuel delivery system 200, shown in FIG. 2. Continuing with FIG. 3A, the motor 226 is also shown. The motor 226 includes a rotational output component 304. The rotational output component 304 is a shaft in the example depicted in FIG. 3. Therefore, the rotational output component may be referred to as a rotational output shaft. However, other suitable rotational output components may be used in other examples. For instance, gears, belts, etc., may be included in the rotational output component. The motor 226 rotates to provide a rotational force to a metering valve actuation device 230. In the example, depicted in FIG. 3A the metering valve actuation device 230 is a screw slider. However, other suitable metering valve actuation devices may be used. For instance, in the example shown in FIG. 5A the metering valve actuation device 230 is a multi-lobe cam. Continuing with FIG. 3A, the screw slider 230 includes an inner shaft 306 coupled rotational output component 304. Therefore, the rotational output component 304 and the inner shaft 306 jointly rotate at the same angular velocity. However in other examples, gearing may be used such that the angular velocity of the rotational output component may not be equal to the angular velocity of the inner shaft.

The rotational axis of the rotational output component 304 is parallel to the rotational axis of the inner shaft 306. Specifically, in the depicted example the rotational output component 304 and the inner shaft 306 share a common rotational axis. However, other relative positions of the inner shaft and the rotational output component have been contemplated.

Figure 3D:
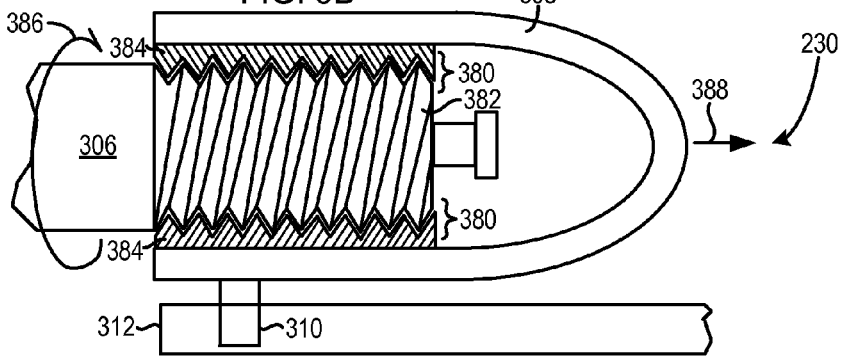
FIGS. 3D-3F shows different views and cross-sections of the second fuel pump shown in FIG. 3A.

The inner shaft 306 includes a helical external thread 382, shown in FIG. 3D discussed in greater detail herein. The inner shaft 306 is at least partially enclosed (e.g., circumferentially enclosed) by an actuation element 308. The actuation element includes a helical internal thread 384, shown in FIG. 3D, on an interior surface of the actuation element 308. The helical internal thread 384 is mated with the helical external thread 382. A guide extension 310 is coupled to an external surface of the actuation element 308. The guide extension 310 is positioned in a guide track 312. Thus, the guide extension 310 is mated with the guide track 312. The guide track substantially inhibits the actuation element 308 from rotating, thereby transferring the rotational force from the motor into a linear force. The linear force may be used to actuate the metering valve 228. It will be appreciated that the actuation element velocity may approach zero when contacting the metering valve. Thus, the fuel pump can be operated with little or no impact between the metering valve and the metering valve actuation device. As a result, metering valve opening and closing noises may be reduced when compared to solenoid operated metering valves. Operation of the screw slider is discussed in greater detail herein with regard to FIGS. 3B and 3C.

The metering valve 228 is a reed valve in the example depicted in FIG. 3A. However, in other examples other suitable metering valves may be utilized. For instance, the example metering valve shown in FIG. 4 is a spring loaded type valve.

As shown the screw slider 230 is in contact with the metering valve 228 and inhibiting the metering valve from closing. The metering valve 228, shown in FIG. 4, includes a valve seat 400, a sealing plate 402 (e.g., disk), and a spring 404. In the example depicted in FIG. 4 the pressure in the pump chamber 234 is less than the pressure in the supply chamber 232 and the sealing plate 402 is spaced away from the valve seat, thereby enabling fuel to flow from the supply chamber 232 to the pump chamber 234. Additionally, the spring 404 is configured to return the sealing plate 402 to the valve seat 400 when the pressure in the pump chamber is greater than a threshold value (e.g., the threshold value may be or equal to the pressure in a supply chamber 232. The supply chamber 232 receives fuel from the first fuel pump 204, shown in FIG. 2. In this way, the metering valve 228 may passively open based on the pressures in the supply chamber and the pump chamber 234.

Returning to FIG. 3A, a flapper 314 of the reed valve 228 is coupled to a housing 316 of the pump chamber 234 via attachment apparatuses 318, such as bolts, screws, welds, etc. The flapper 314 is flexible in the depicted example. The reed valve 228 is shown in a closed position in the example depicted in FIG. 3A. In the closed position the flapper 314 is seated and sealed on a surface of a pump chamber housing 316. Thus, the flapper 314 in the closed position substantially inhibits fluidic communication between the supply chamber 232 and the pump chamber 234. Therefore, in a closed position the flapper extends across the pump chamber inlet. However, in an open positioned a portion of the flapper is spaced away from the surface of the pump chamber housing.

Further, it will be appreciated that a pump chamber pressure does not exceed a threshold actuation pressure in the example depicted in FIG. 3A. Therefore, the threshold actuation pressure may be a pressure value which initiates opening and closing of the reed valve 228. The threshold value may be substantially equivalent to a supply chamber pressure, in one example. In this way, the reed valve 228 passively opens and closes based on the pressure differential between the supply chamber 232 and pump chamber 234. Therefore, in a closed position a first side of the flapper 314 is exposed to the supply chamber pressure and a second side of the flapper is exposed to the pump chamber pressure. This type of passive operation may increase the reliability of the second fuel pump as well as decrease the energy used by the pump. The flapper 314 may comprise a flexible metal, polymeric material, and/or other suitable material configured to flex when exposed to a pressure differential.

The actuation element 308 of the screw slider 230 is shown spaced away from the reed valve 228 in the example depicted in FIG. 3A. However, in other examples, the actuation element 308 may be in contact with the flapper 314.

The check valve 240 is also shown positioned in an outlet conduit 319, in FIG. 3A. The check valve 240 is configured to open, enabling fuel to flow therethrough when a pump chamber pressure exceeds a predetermined threshold value. The check valve 240 inhibits fuel from flowing upstream back into the fuel pump. As shown, fuel may flow from the outlet conduit 319 to downstream components such as the fuel rail 218, shown in FIG. 2. Cutting plane 392 defines the cross-section shown in FIG. 3E and cutting plane 294 defines the viewing angle shown in FIG. 3F.

FIGS. 3B and 3C show the reed valve 228 in an open configuration in which fuel can flow between the supply chamber 232 and the pump chamber 234. When, the plunger 236, shown in FIG. 3A, is moving in an upward direction such that the volume of the pump chamber 234 is decreasing, fuel flows from the pump chamber 234 to the supply chamber 232. On the other hand, when the plunger 236, shown in FIG. 3A, is moving in a downward direction, the reed valve 228 closes due to the pressure differential between the supply chamber and the pump chamber. In this way, the reed valve 228 may be passively opened and closed based on the pressure in the pump chamber. The pump may be operated in this way when there is a high fuel demand in the engine. However, the screw slider 230 may also be actuated to inhibit the reed valve from closing when the pump chamber pressure is greater than the supply chamber pressure. In this way, the output of the second fuel pump may be adjusted based on engine operating conditions, if desired.

FIG. 3B shows the reed valve 228 in an open configuration in which the screw slider 230 is not exerting a linear actuation force on the reed valve 228. The linear actuation force is discussed in greater detail herein. The cutting plane 350 defining the cross-section of the screw slider 230 shown in FIG. 3D is illustrated in FIG. 3B.

FIG. 3C shows the reed valve 228 in an open configuration in which the actuation element 308 of the screw slider 230 is exerting a linear actuation force, denoted via arrow 370, on the reed valve 228. Specifically, the actuation element 308 is exerting the linear force on the reed valve 228. In this way, the reed valve 228 is inhibited from closing via the screw slider 230. It will be appreciated that the screw slider 230 may be actuated to exert a linear force on the reed valve 228 when the pump chamber pressure exceeds the supply chamber pressure. The pump chamber pressure may exceed the supply chamber pressure when the plunger is moving upward and decreasing the volume in the pump chamber 234. Thus, the screw slider 230 is configured to inhibit the reed valve 228 from closing when the pump chamber pressure is increasing and/or exceeds a threshold value.

FIG. 3D shows a cross-sectional view of the screw slider 230 including the actuation element 308 and the inner shaft 306.

The screw slider 230 includes a thread interface 380. The thread interface 380 includes a helical external thread 382 mated with a helical internal thread 384. The helical internal thread 384 is included in the actuation element 308 and the external helical thread 382 is included in the inner shaft 306. The pitch of the threads may be selected based on a desired linear speed of the actuation element 308 during screw slider operation.

The guide track 312 and the guide extension 310 are also shown in FIG. 3D. The guide extension 310 is fixedly coupled to the actuation element 308. The guide track 312 substantially inhibits the actuation element 308 from rotating. It will be appreciated that the guide track 312 is fixedly coupled to a housing in the second fuel pump 206.

When inner shaft 306 rotates, the rotation denoted via arrow 386, the rotational energy is transferred into linear movement of the actuation element 308, denoted via arrow 388. In FIG. 3D, the linear movement is depicted in a direction toward the reed valve 228, shown in FIG. 3B. However, in other examples the linear movement may be away from the reed valve. The direction of linear movement may be based on the orientation of the threads. In this way, the linear movement of the actuation element 308 enables the reed valve 228 to be held open or closed after it is held open. It may be desirable to hold the reed valve 228 open when the fuel demand in the engine is low, for instance.

Figure 3E:
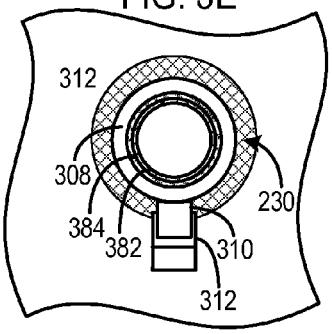

FIG. 3E shows another cross-sectional view of the screw slider 230 including the actuation element 308, the inner shaft 306, guide track 312, and guide extension 310. As shown the guide extension 310 is partially enclosed in the guide track 312. As shown, the guide track 312 substantially inhibits side to side movement of the guide extension 310. Thus, the rotational movement of the actuation element is substantially inhibited.

Figure 3F:
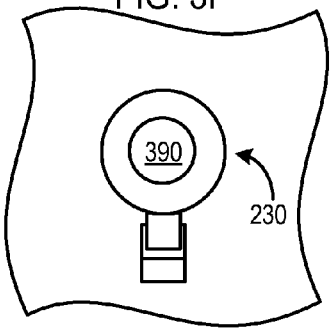

The helical external thread 382 included in the inner shaft 306 and the helical internal thread 384 included in the actuation element 308 are also shown in FIG. 3F.

FIG. 3F shows a front view of the screw slider 230 including the actuation element 308. Again the guide track 312 and the guide extension 310 are depicted. A front surface 390 of the actuation element 308 may be curved. The curvature may reduce the likelihood of reed valve damage caused by the actuation element contacting the flapper of the reed valve.

FIG. 5A shows a second example of the second fuel pump 206. The second example of the second fuel pump 206 includes many of the parts in the first example of the second fuel pump 206 shown in FIG. 3A. Therefore, similar parts are labeled accordingly. The pump chamber 234, supply chamber 232, plunger 236, motor 226, metering valve 228, metering valve actuation device 230, and check valve 240 are shown in FIG. 5A. The metering valve actuation device 230 shown in FIG. 5A includes a cam 500 fixedly coupled to a shaft 502. The shaft 502 is coupled (e.g., fixedly coupled) to the rotational output component 304 of the motor 226. It will be appreciated that the motor may adjust the rotational output provided to the shaft 502 to actuate the metering valve 228. The metering valve 228 is a reed valve 228 in the example depicted in FIG. 5A. However, other suitable metering valves may be used in other examples, such as the metering valve shown in FIG. 4.

The geometry of the cams enables the reed valve to be opened and closed by the cams based on the rotational position of the cams. Specifically, the cam may have a plurality of lobes. Each of the lobes is configured to hold the reed valve 228 in an open position when contacting the flapper 314. Rotation of the cam 500 enables the lobe to contact the flapper 314. However, when the lobe is not contacting the flapper 314 the cam 500 does not hold the reed valve in an open position. The cam 500 may be rotated to enable this type of valve actuation.

FIG. 5B shows the cam 500 holding the reed valve 228 in an open position. Thus, the cam 500 is exerting a linear actuation force on the flapper of the reed valve 228 and the flapper may be exerting an equal and opposite force on the cam 500. It will be appreciated that when the supply chamber pressure is greater than the pump chamber pressure fuel flows from the supply chamber to the pump chamber in the example shown in FIG. 5B. However, if the pump chamber pressure is greater than the supply chamber pressure fuel may flow from the pump chamber to the supply chamber. Fuel may flow in this way when a full pump stroke is not requested in the engine.

FIG. 5C shows the reed valve 228 in an open position and the cam 500 spaced away from the reed valve. It will be appreciated that the pressure in the pump chamber 234 may be greater than the pressure in the supply chamber 232 in FIG. 5C. Thus, the reed valve 228 shown in FIG. 5C is passively opened via a pressure differential. Opening the reed valve in this way does not produce any NVH in the valve.

FIG. 6A-6E shows different example multi-lobe cams. It will be appreciated that the motor 226 shown in FIG. 5A may be energized to rotation each of the cams 500 by a desired amount to enable opening or closing of the reed valve via the cams.

Figure 6A:
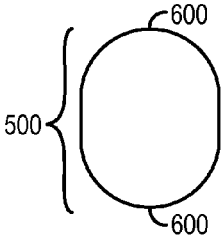
FIGS. 6A-6E show different example cams included in the second fuel pump shown in FIG. 5A.

FIG. 6A shows a first example cam 500 having two lobes 600. It will be appreciated that the cam may be rotated 90 degrees to move the cam between an actuating and non-actuating position.

Figure 6B:
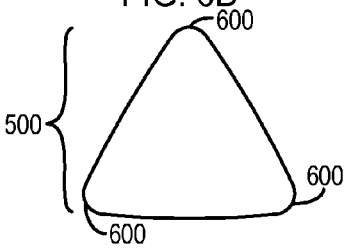

FIG. 6B shows a second example cam 500 having three lobes 600. It will be appreciated that the cam may be rotated 60 degrees to move the cam between an actuating and non-actuating position.

Figure 6C:
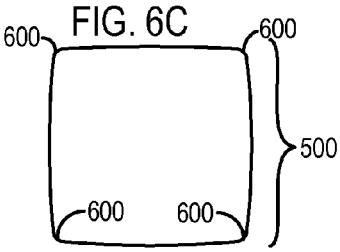

FIG. 6C shows a third example cam 500 having four lobes 600. It will be appreciated that the cam may be rotated 45 degrees to move the cam between an actuating and non-actuating position.

Figure 6D:
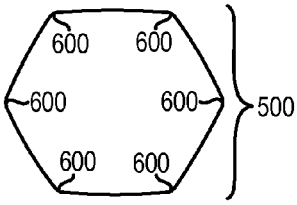

FIG. 6D shows a third example cam 500 having six lobes 600. It will be appreciated that the cam may be rotated 30 degrees to move the cam between an actuating and non-actuating position.

Figure 6E:
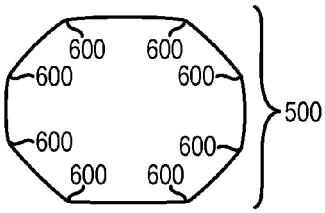

FIG. 6E shows a third example cam 500 having eight lobes 600. It will be appreciated that the cam may be rotated 22.5 degrees to move the cam between an actuating and non-actuating position.

FIG. 7 shows a method 700 for operating a fuel pump. The method may be implemented by the fuel pump and components discussed above with regard to FIGS. 1-6E or may be implemented by another suitable fuel pump.

At 702 the method includes decreasing a pump chamber pressure. Decreasing the pump chamber pressure may include increasing a pump chamber volume via movement of a plunger in the pump chamber to decrease the pump chamber pressure beyond a threshold value. The threshold value may be a supply chamber pressure, in one example.

Next at 704 the method includes passively opening a metering valve coupled to a pump chamber in response to the decreasing. Specifically in one example, the reed valve may open when the pump chamber pressure is less than the supply chamber pressure. Additionally, the metering valve may be a reed valve in one example or may be a multi-lobe cam in another example.

At 706 it is determined if a full fuel pump stroke has been requested. A full fuel pump stroke may be requested when the engine fuel pressure and fuel demand is high. For example, a full fuel pump stroke may be requested during an open throttle condition.

If a full fuel pump stroke is requested (YES at 706) the method proceeds to 708. At 708 the method includes increasing the pump chamber pressure and at 710 the method includes passively closing the metering valve coupled to a pump chamber in response to the increase in pump chamber pressure.

However, if a full fuel pump stroke is not requested (NO at 706) the method proceeds to 712. At 712 the method includes generating a rotational output via a motor. At 714 the method further includes transferring the rotational output into an actuation force applied to the metering valve via a metering valve actuation device and at 716 the method includes inhibiting the metering valve from closing via sustaining application of the actuation force. In one example, the metering valve actuation device may be a screw slider converting the rotational output into linear force of an actuation element in the screw slider. However, in another example the metering valve actuation device may be a multi-lobe cam including a plurality of cams. Additionally, step 712-716 may be implemented during a first operating condition. The first operating condition may be when a pump chamber pressure is decreasing and/or is less than the supply chamber pressure. Further in one example, the first operating condition may while the metering valve is open.

At 718 the method includes increasing the pump chamber pressure. Specifically, in one example the pump chamber pressure may be increased such that it is greater than the supply chamber pressure. It will be appreciated, that the plunger in the pump may be moved to increase the pressure in the pump chamber.

At 720 the method includes removing the sustained application of the actuation force on the metering valve applied by the metering valve actuation device to close the metering valve. Removing the sustained application of the actuation force to the metering valve may include generating a second rotational output via the motor in a direction opposing the first rotational output, in one example. In another example, removing the sustained application of the actuation force may be implemented while the pump chamber pressure is increasing. Specifically, removing the sustained application of the actuation force may be implemented while the pump chamber pressure is greater than the supply chamber pressure. The time period when step 720 is implemented may be selected based on engine fuel demands. For example, when a greater amount of fuel and/or fuel pressure is needed in the engine step 720 may be implemented closer to the bottoms of the plunger's stroke.

Step 720 is implemented during a second operating condition. The second operating condition may be when the volume in the pump chamber is decreasing and the pump chamber pressure is greater than the supply chamber pressure. Additionally or alternatively, the second operating condition may be when the fuel demand is the engine is less than a threshold value. In one example, the threshold value may correspond to maximum fuel demand.

FIG. 8 shows a method 800 for operating a fuel pump. The method may be implemented by the fuel pump and components described above with regard to FIGS. 1-6E or may be implemented by another suitable fuel pump and components.

At 802 the method includes generating rotational output from a motor. At 804 the method includes transferring the rotational output into a linear force in a screw slider. Next at 806 the method includes actuating a reed valve via the screw slider via the linear force, the reed valve coupled to a pump chamber inlet. In one example, actuating the reed valve includes inhibiting the reed valve from closing when a pump chamber pressure is increasing. In another example, actuating the reed valve includes removing a force applied to the reed valve when a pump chamber pressure exceeds a metering valve chamber pressure. In a further example, transferring the rotational output into a linear force via a screw slider includes rotating an external thread through an internal thread. In another example, transferring the rotational output into a linear force includes moving the screw slider axially away from or towards a rotational output shaft of the motor.

Methods 700 and 800 may be stored in controller 12 and/or motor controller 222 shown in FIGS. 1 and 2. Specifically, methods 700 and 800 may be stored in memory executable by a processor, if desired.

As will be appreciated by one of ordinary skill in the art, methods described in FIGS. 7 and 8 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for operating a fuel delivery system of an internal combustion engine comprising:

decreasing a pressure in a pump chamber of a fuel pump, the fuel pump adapted to receive fuel from an engine fuel tank and deliver fuel to an engine fuel rail;

passively opening a metering valve to couple the pump chamber with a supply chamber of the fuel pump in response to the decreasing; and while the metering valve is open, generating a rotational output via a motor, transferring the rotational output into an actuation force applied to the metering valve via a multi-lobe cam of a metering valve actuation device arranged in the supply chamber, and inhibiting the metering valve from closing via sustaining application of the actuation force, wherein the multi-lobe cam is fixedly coupled to a shaft, the shaft fixedly coupled to a rotational output component of the motor, and wherein the geometry of the multi-lobe cam enables the metering valve to be opened and closed by the multi-lobe cam based on a rotational position of the multi-lobe cam, each lobe of the multi-lobe cam configured to hold the metering valve in an open position when contacting the metering valve.

2. The method of claim 1, where decreasing the pump chamber pressure includes increasing a pump chamber volume via movement of a plunger in the pump chamber to decrease the pump chamber pressure beyond a threshold value.

3. The method of claim 2, where the threshold value is a pressure of the supply chamber.

4. The method of claim 1, further comprising removing the sustained application of the actuation force on the metering valve applied by the metering valve actuation device to close the metering valve.

5. The method of claim 4, where removing the sustained application of the actuation force to the metering valve includes generating a second rotational output via the motor.

6. The method of claim 4, where removing the sustained application of the actuation force is implemented while the pump chamber pressure is increasing.

7. The method of claim 4, where generating the rotational output, transferring the rotational output, and inhibiting the metering valve from closing are implemented during a first operating condition and removing the sustained application of the actuation force is implemented during a second operating condition.

8. The method of claim 7, wherein the second operating condition occurs when an engine fuel demand is less than a threshold value.

9. The method of claim 8, wherein the threshold value corresponds to a maximum fuel demand.

10. The method of claim 1, where the metering valve is a reed valve.

11. A method for operating a fuel pump in a fuel delivery system of an internal combustion engine, comprising:

decreasing a pressure in a pump chamber of the fuel pump, the fuel pump having an outlet arranged in the pump chamber which is adapted to deliver fuel to an engine fuel rail;

passively opening a reed valve to couple the pump chamber with a supply chamber of the fuel pump in response to the decreasing, the fuel pump having an inlet arranged in the supply chamber which is adapted to receive fuel from an engine fuel tank; and while the reed valve is passively open, generating a rotational output from a motor;

transferring the rotational output into a linear force in a screw slider arranged in the supply chamber of the fuel pump applying the linear force to the reed valve via the screw slider, and inhibiting the reed valve from passively closing when the pressure in the pump chamber is increasing by sustaining application of the linear force.

12. The method of claim 11, further comprising removing the linear force applied to the reed valve when the pressure in the pump chamber exceeds a pressure in the supply chamber.

13. The method of claim 11, where transferring the rotational output into a linear force in the screw slider includes rotating an external thread through an internal thread.

14. The method of claim 11, where transferring the rotational output into a linear force in the screw slider includes moving the screw slider axially away from or towards a rotational output shaft of the motor which shares a common rotational axis with an inner shaft of the screw slider.

15. The method of claim 11, further comprising selecting a time to remove the linear force applied to the reed valve based on engine fuel demands.

16. A fuel pump in a fuel delivery system of an internal combustion engine comprising:

an inlet adapted to receive fuel from an engine fuel tank, the inlet arranged in a supply chamber of the fuel pump;

an outlet adapted to deliver fuel to an engine fuel rail, the outlet arranged in a pump chamber of the fuel pump;

a motor having a rotational output shaft; and a screw slider arranged in the supply chamber, the screw slider coupled to the rotational output shaft and converting a rotation force from the rotational output shaft into a linear valve actuation force applied to a metering valve via an actuation element of the screw slider, the metering valve coupled to an inlet of the pump chamber, a curved front surface of the actuation element configured to contact the metering valve when the linear valve actuation force is applied to the metering valve, wherein the curved front surface lies on a longitudinal axis of the screw slider.

17. The fuel pump of claim 16, where the metering valve is a reed valve comprising a flexible flapper extending across the pump chamber inlet.

18. The fuel pump of claim 16, where the screw slider comprises an inner shaft having an external thread mated with an internal thread in the actuation element, the actuation element including a guide extension positioned in a guide track inhibiting rotational movement of the actuation element.

19. The fuel pump of claim 18, where the inner shaft of the screw slider shares a common rotational axis with a rotational output component of the motor.

20. The fuel pump of claim 16, where the metering valve includes a spring exerting a force on a valve plate when the metering valve is in an open configuration.

* * * * *